US006244686B1

(12) United States Patent
Jensen et al.

(10) Patent No.: US 6,244,686 B1
(45) Date of Patent: Jun. 12, 2001

(54) PRINT HEAD DRIVE MECHANISM

(75) Inventors: James B. Jensen, Woodburn; Brent R. Jones, Tualatin; David L. Knierim, Wilsonville, all of OR (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/298,644

(22) Filed: Apr. 23, 1999

(51) Int. Cl.[7] ..... B41J 23/00

(52) U.S. Cl. ..... 347/37; 400/317; 400/320

(58) Field of Search ..... 347/37, 38, 39, 347/40, 41, 117, 167, 22, 260; 400/157, 315, 313, 317, 322, 328, 320; 74/89.15, 572; 310/76; 360/105

(56) References Cited

U.S. PATENT DOCUMENTS

| | | | | |
|---|---|---|---|---|
| 3,757,922 | * | 9/1973 | Sweeney | 400/157 |
| 3,831,829 | * | 8/1974 | Karpisek | 226/83 |
| 3,871,246 | * | 3/1975 | Craven | 74/665 GD |
| 3,945,481 | | 3/1976 | Lindberg . | |
| 4,019,616 | * | 4/1977 | Thorne | 74/89.15 |
| 4,114,750 | * | 9/1978 | Baeck et al. | 400/315 |
| 4,345,846 | * | 8/1982 | Mathews | 400/157 |
| 4,489,248 | * | 12/1984 | Petersen | 310/76 |
| 4,613,245 | | 9/1986 | Ikeda et al. | 400/313 |
| 4,841,397 | * | 6/1989 | Maeda | 360/105 |
| 5,389,958 | | 2/1995 | Bui et al. | 347/103 |
| 5,450,770 | * | 9/1995 | Bellemure et al. | 74/572 |
| 5,479,194 | * | 12/1995 | Hirano | 347/22 |
| 5,625,390 | | 4/1997 | Burke et al. | 347/41 |
| 5,734,393 | | 3/1998 | Eriksen | 347/41 |
| 5,739,843 | * | 4/1998 | Straayer et al. | 347/260 |
| 5,809,833 | * | 9/1998 | Newport et al. | 74/89.15 |
| 5,818,497 | | 10/1998 | Kerr et al. | 347/234 |
| 5,917,518 | * | 6/1999 | Ohashi | 347/37 |
| 5,949,452 | | 9/1999 | Jones | 347/41 |

* cited by examiner

*Primary Examiner*—Eugene Eickholt
(74) *Attorney, Agent, or Firm*—Charles F. Moore

(57) ABSTRACT

A print head drive mechanism utilizing a lead screw is provided. In one embodiment, the print head drive mechanism comprises a lead screw that is coupled to the print head and extends through the threaded hub of a gear. The gear is driven by a stepper motor through a pinion. A support cylinder extends from one face of the gear and includes a tapered nose that seats within a recess in a brace. The thread pitch of the lead screw matches the jet spacing in the print head to minimize positional offsets due to component irregularities and misalignments. In another embodiment, the print head is coupled to at least one nut that is translated by a rotating lead screw, with the lead screw having a thread pitch that matches the jet spacing in the print head.

19 Claims, 6 Drawing Sheets

PRINT HEAD DRIVE MECHANISM

CROSS-REFERENCE TO RELATED APPLICATIONS

Not applicable.

STATEMENT REGARDING FEDERALLY SPONSORED RESEARCH OR DEVELOPMENT

Not applicable.

FIELD OF INVENTION

This invention relates generally to a mechanism for translating a print head in an imaging apparatus and, more specifically, to a print head drive mechanism that reduces positional variances to improve ink drop placement accuracy.

BACKGROUND OF THE INVENTION

Ink-jet printing systems commonly utilize either a direct printing or an offset printing architecture. In a typical direct printing system, ink is ejected from jets in the print head directly onto the final receiving medium. In an offset printing system, the print head jets the ink onto an intermediate transfer surface, such as a liquid layer on a drum. The final receiving medium is then brought into contact with the intermediate transfer surface and the ink image is transferred and fused into the medium.

In many direct and offset printing systems, the print head moves relative to the final receiving medium or the intermediate transfer surface in two dimensions as the print head jets are fired. Typically, the print head is translated along an X-axis while the final receiving medium/intermediate transfer surface is moved perpendicularly along a Y-axis. In this manner, the print head "scans" over the print medium and forms a dot-matrix image by selectively depositing ink drops at specific locations on the medium.

In a typical offset printing architecture, the print head moves in an X-axis direction that is parallel to the intermediate transfer surface as a drum supporting the surface is rotated. Typically, the print head includes multiple jets configured in a linear array to print a set of scan lines on the intermediate transfer surface with each drum rotation. Precise placement of the scan lines is necessary to meet image resolution requirements and to avoid producing undesired printing artifacts, such as banding and streaking. Accordingly, the X-axis (head translation) and Y-axis (drum rotation) motions must be carefully coordinated with the firing of the jets to insure proper scan line placement.

Prior ink jet printers have utilized various implementations of a lead screw mechanism to impart X-axis movement to a print head. An exemplary patent that discloses a lead screw positioning mechanism is U.S. Pat. No. 4,613,245 for DEVICE FOR CONTROLLING THE CARRIAGE RETURN OF A LEAD SCREW DRIVEN PRINTING HEAD (the '245 patent).

Prior lead screw print head drive mechanisms can introduce positional errors due to component imperfections and system inaccuracies. These imperfections and inaccuracies may include irregularities in drive system components, thread imperfections, axial misalignments and similar component and manufacturing-related variations. In a lead screw mechanism, these sources of positional error tend to be manifested in cyclical repetitions that correspond to the characteristics and gear ratios of the drive system componentry. In printing architectures that generate images using scan lines, these positional errors can introduce undesirable white space between adjacent scan lines and produce other printing artifacts that reduce image quality.

These positional errors can be controlled to some degree by the use of precision components and control systems in the drive mechanism. However, such precision components and control systems are more expensive and often more time-intensive to manufacture and assemble.

Accordingly, what is needed is a low cost, low complexity lead screw drive mechanism for a print head that provides improved positional accuracy and overcomes the drawbacks of prior systems.

SUMMARY OF THE INVENTION

It is an aspect of the present invention to provide a lead screw drive mechanism for a print head that overcomes the drawbacks of prior systems.

It is another aspect of the present invention to provide a lead screw drive mechanism that minimizes positional offsets due to imperfections in drive system components and control systems.

It is a feature of the present invention that the thread pitch of the lead screw is calibrated to the spacing between adjacent jets in the print head to reduce positional offsets.

It is another feature of the present invention that the angular positions of the driving motor and the driven gear that is coupled to the lead screw are substantially equal for any pair of adjacent scan lines.

It is an advantage of the present invention that the lead screw drive mechanism provides improved ink drop placement accuracy to eliminate white space between adjacent pixel columns.

It is another advantage of the present invention that the lead screw drive mechanism is a simple, low cost and reliable mechanism.

To achieve the foregoing and other aspects, features and advantages, and in accordance with the purposes of the present invention as described herein, a print head drive mechanism utilizing a lead screw to translate the print head is provided. In one embodiment, the print head drive mechanism comprises a lead screw that is coupled to the print head and extends through the threaded hub of a gear. The gear is driven by a stepper motor through a pinion. A support cylinder extends from one face of the gear and includes a tapered nose that seats within a recess in a brace. The thread pitch of the lead screw matches the jet spacing in the print head to minimize positional offsets due to component irregularities and misalignments. In another embodiment, the print head is coupled to at least one nut that is translated by a lead screw, with the lead screw having a thread pitch that matches the jet spacing in the print head.

Still other aspects of the present invention will become apparent to those skilled in this art from the following description wherein there is shown and described a preferred embodiment of this invention, simply by way of illustration of one of the modes best suited to carry out the invention. As it will be realized, the invention is capable of other different embodiments and its several details are capable of modifications in various, obvious aspects all without departing from the invention. Accordingly, the drawings and descriptions will be regarded as illustrative in nature and not as restrictive. And now for a brief description of the drawings.

Reference will now be made in detail to the present preferred embodiment of the invention, an example of which is illustrated in the accompanying drawings.

DETAILED DESCRIPTION OF THE PREFERRED EMBODIMENT

Figure 1:
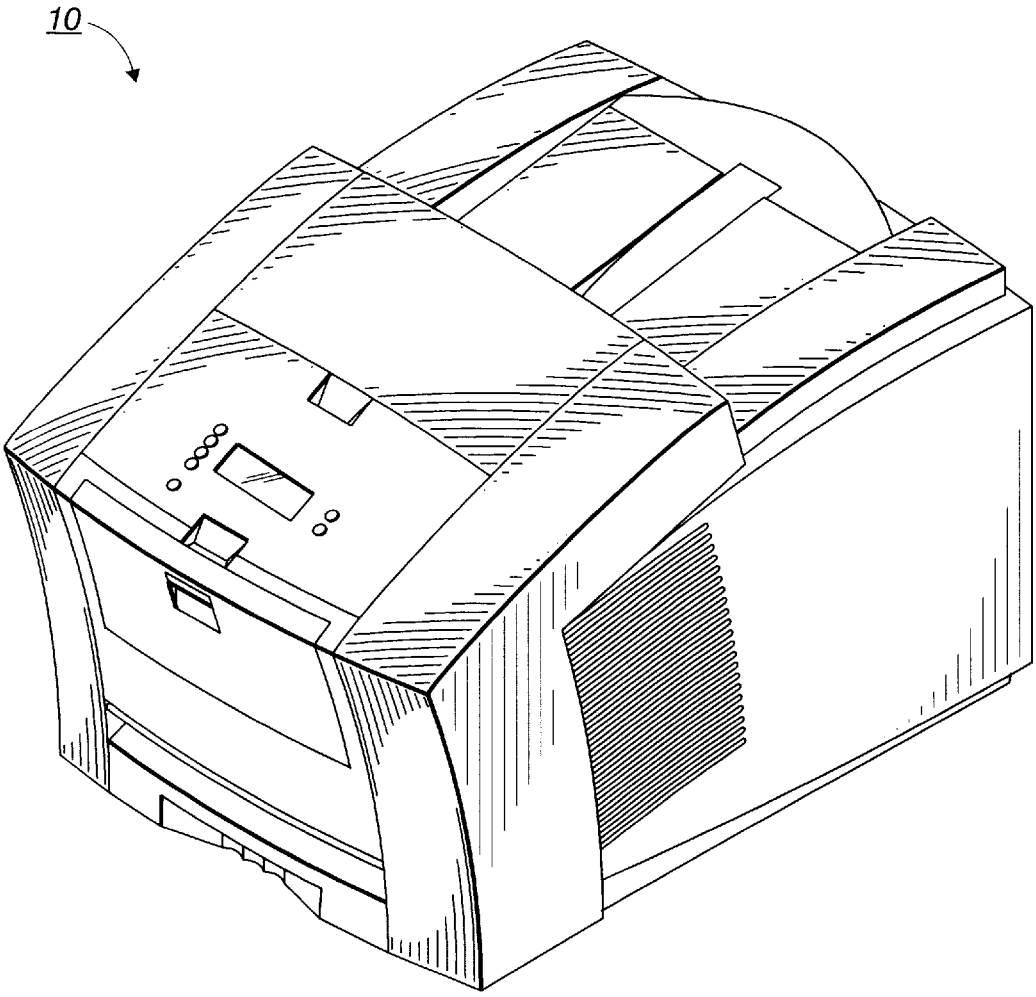
FIG. 1 is an overall perspective view of an offset ink jet printer that uses the print head drive mechanism of the present invention.
Figure 2:
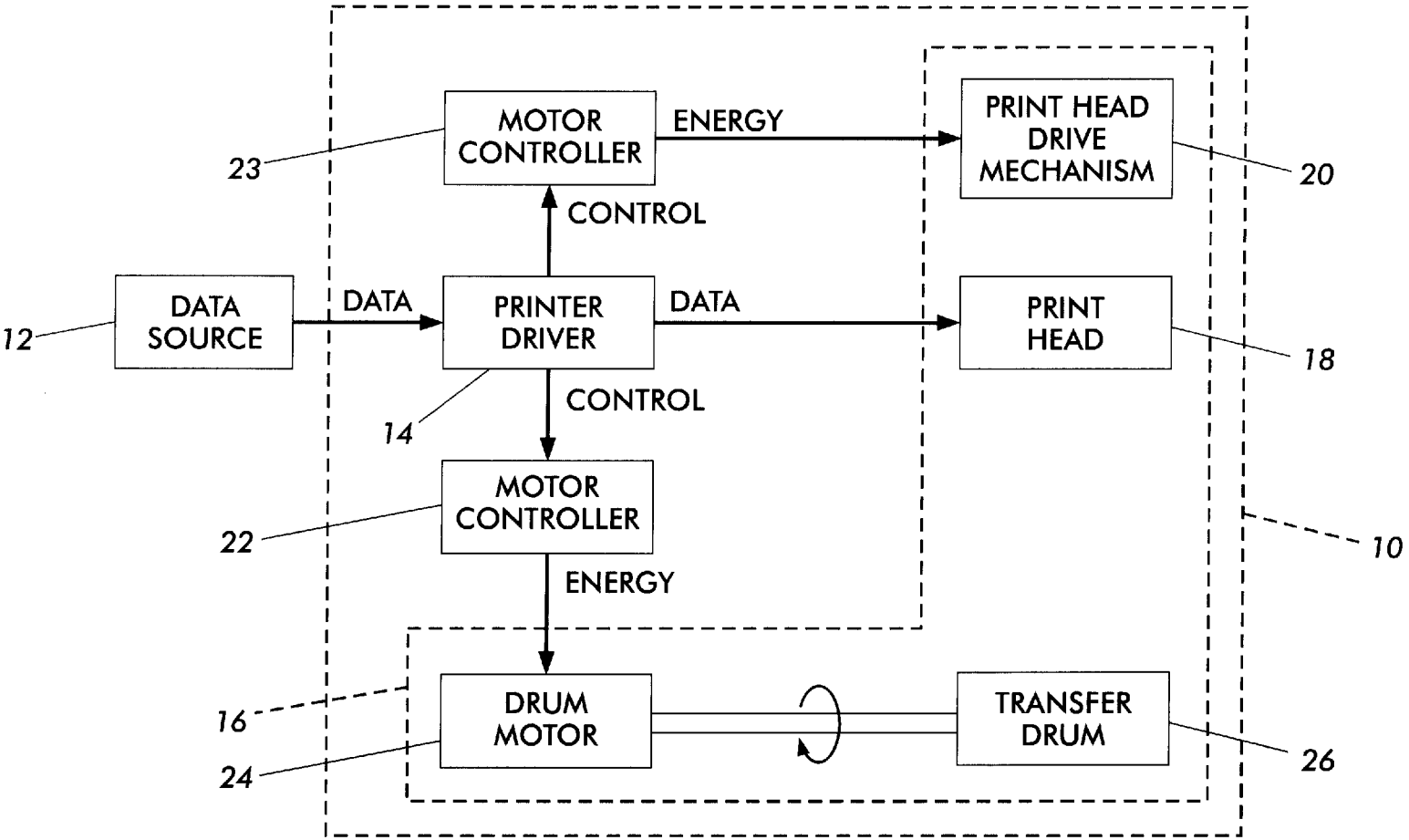
FIG. 2 is a simplified schematic illustration of the operational components of the printer of FIG. 1.

FIG. 1 is an overall perspective view of an offset ink-jet printing apparatus 10 that utilizes the print head drive mechanism of the present invention. FIG. 2 is a simplified schematic illustration of the operational components of the printer of FIG. 1. An example of an offset printing architecture is disclosed in U.S. Pat. No. 5,389,958 (the '958 patent) entitled IMAGING PROCESS and assigned to the assignee of the present application. The '958 patent is hereby incorporated by reference in pertinent part. The following description of preferred embodiments of the present invention refers to its use in this type of printing architecture. The present invention may also be used with various other ink-jet printing apparatus that utilize different architectures, such as offset printing apparatus that use a shuttling print head and direct printing apparatus in which ink is jetted directly onto a final receiving medium. Accordingly, the following description will be regarded as merely illustrative of exemplary embodiments of the present invention.

With reference to FIG. 2, the printing apparatus 10 receives imaging data from a data source 12. A printer driver 14 within the printer 10 processes the imaging data and controls the operation of print engine 16. The printer driver 14 feeds formatted imaging data to a print head 18 and controls the movement of the print head by sending control data to a first motor controller 23 that activates the print head drive mechanism 20. The driver 14 also controls the rotation of the transfer drum 26 by providing control data to a second motor controller 22 that activates the drum motor 24.

Figure 3:
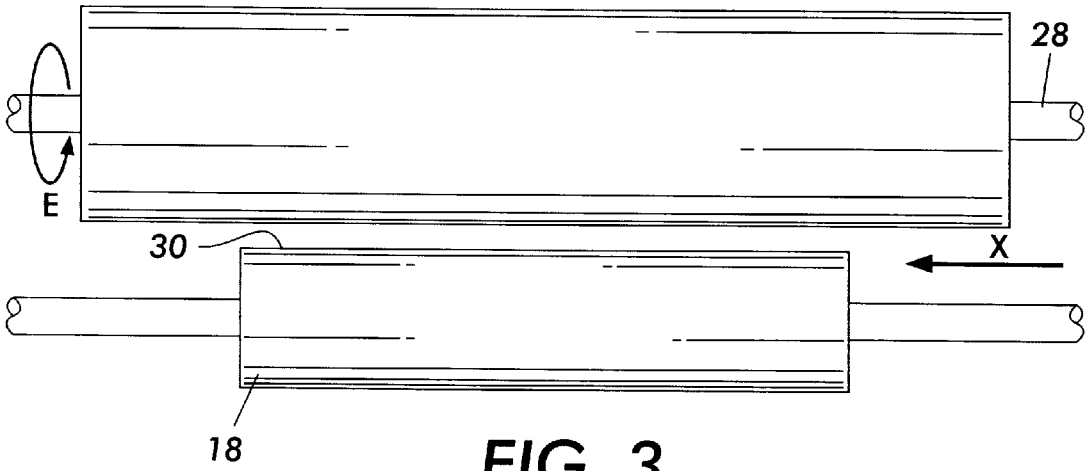
FIG. 3 is a top pictorial view showing the print head mounted to a shaft for translation along an X-axis parallel to the transfer drum.

With reference now to FIG. 3, in operation the print head 18 is moved parallel to the transfer drum 26 along an X-axis as the drum 26 is rotated and the print head jets (not shown) are fired. In this manner, an ink image is deposited on an intermediate transfer layer (not shown) that is supported by the outer surface of the drum 26. When the image is fully deposited on the intermediate transfer layer, a final receiving medium, such as a sheet of paper or a transparency, is brought into contact with the transfer drum 26, and the deposited image is simultaneously transferred and fused into the medium.

With continued reference to FIG. 3, the print head 18 includes a face 30 that extends parallel to the transfer drum 26. The drum 26 rotates about a shaft 28 in the direction of action arrow E. As the drum rotates and the print head 18 moves along the X-axis, a plurality of ink jets (not shown) on the face 30 eject ink onto the intermediate transfer layer (not shown) on the drum 26. One rotation of the transfer drum 26 and a simultaneous translation of the print head 18 along the X-axis while firing the ink jets 46 results in the deposition of an angled scan line on the intermediate transfer layer of the drum 26. It will be appreciated that one scan line has an approximate width of one pixel (one pixel width). In 300 dots per inch (dpi) (118 dots per cm.) printing, for example, one pixel has a width of approximately 0.003 inches (0.085 mm). Thus, the width of one 300 dpi scan line equals approximately 0.003 inches.

Figure 4:
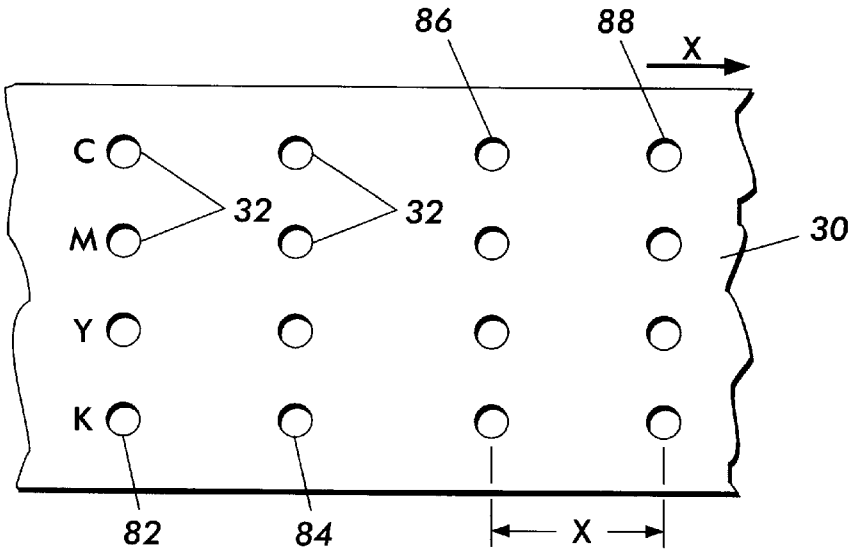
FIG. 4 is an enlarged elevational view of a portion of the print head face showing parallel vertical columns of ink jets, each column having from top to bottom a cyan, magenta, yellow and black ink jet.

FIG. 4 illustrates a portion of the face 30 of the print head 18 as viewed from the intermediate transfer layer of the drum 26. Parallel vertical columns comprising four ink jets 32 each are located across the face 30. While only four columns 82, 84, 86 and 88 are shown, it will be appreciated that the preferred print head 18 utilizes 112 columns of ink jets 32. Each column of jets 32 includes from top to bottom a cyan C, magenta M, yellow Y and black K ink jet. In this manner, individual ink droplets from a single column of ink jets 32 may overlay each other during a scan of the print head 18 to produce a desired color.

Line interlacing may be used with this type of print head 18 to create an ink image on the transfer drum 26. Line interlacing entails printing adjacent scan lines with different columns of ink jets 32. For example, in a three to one (3:1) interlace, scan lines 1, 4, 7, etc. are printed with a first column of jets, lines 2, 5, 8, etc. are printed with a second column of jets, lines 3, 6, 9, etc. are printed with a third column of jets and so forth. A more detailed discussion of line interlacing is presented in U.S. Pat. No. 5,734,393 for INTERLEAVED INTERLACED IMAGING (the '393 patent) and co-pending U.S. patent application Ser. No. 08/757,366 now U.S. Pat. No. 5,949,452 (the '366 application), both being assigned to the assignee of the present application. The '393 patent and the '366 application are hereby incorporated by reference in pertinent part.

With continued reference to FIG. 4, adjacent columns of ink jets 32 are spaced apart along the X-axis by a distance X. This interjet spacing X determines the number of adjacent scan lines that must be printed to produce a solid fill image. As a single scan line corresponds to one rotation of the transfer drum 26 and a simultaneous movement or step of the print head 18 along the X-axis, the interjet spacing X also dictates the number of rotations of the drum that must occur to create a solid fill image. For example, a print head 18 having an interjet spacing of X=10 pixel widths requires 10 rotations of the transfer drum to produce a solid fill image.

As explained above, a scan line is printed by rotating the transfer drum 26 while simultaneously moving the print head 18 in the X-axis direction and firing the ink jets 32. To create the above-described 3:1 interlace, the print head 18 moves or steps a distance of three pixel widths in the X-axis direction for every rotation of the transfer drum 26. In practice, the print head drive mechanism 20 moves the print head 18 at a generally constant velocity while the transfer drum 26 rotates.

Figure 5:
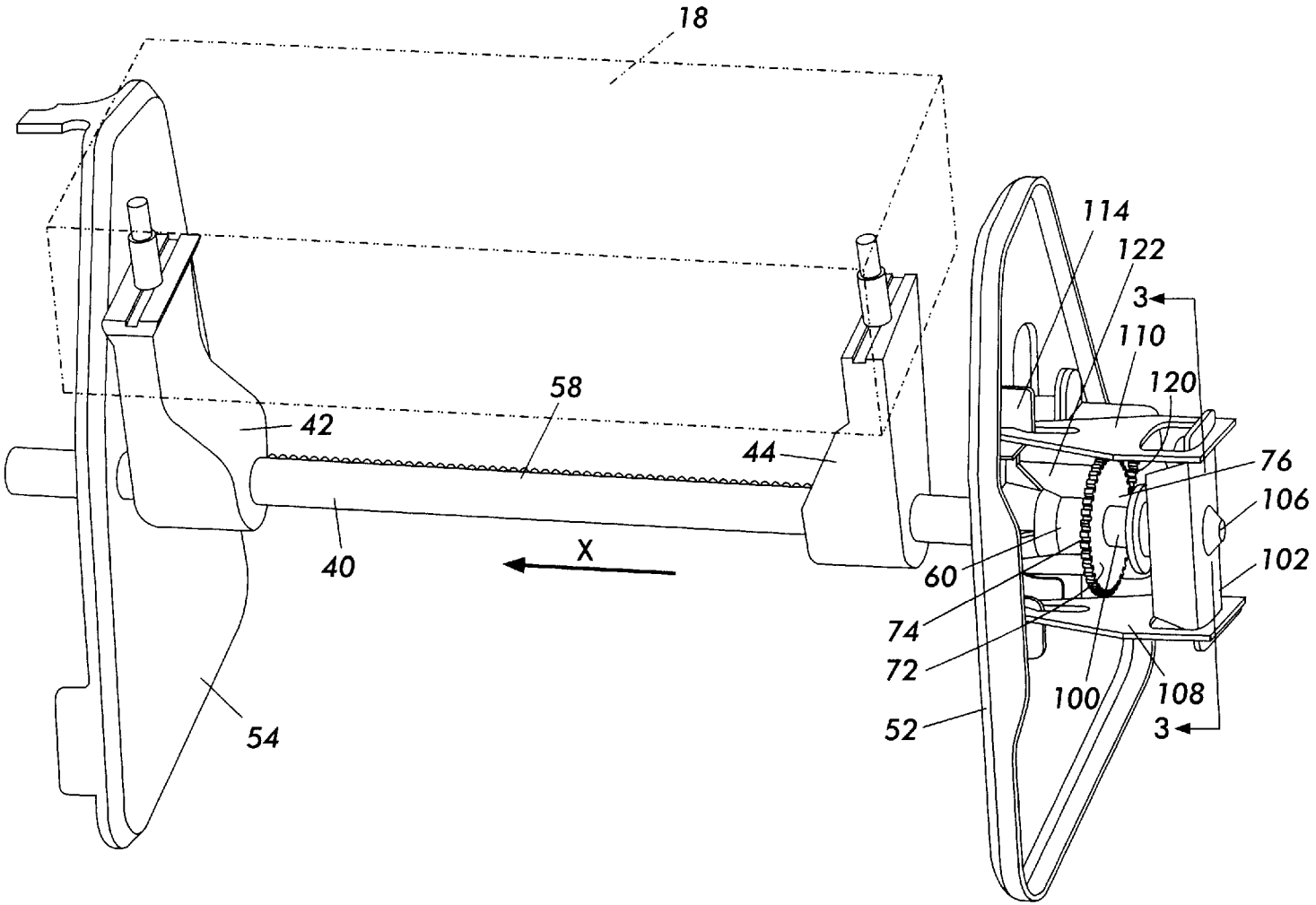
FIG. 5 is a perspective view of the print head drive mechanism of the present invention.
Figure 6:
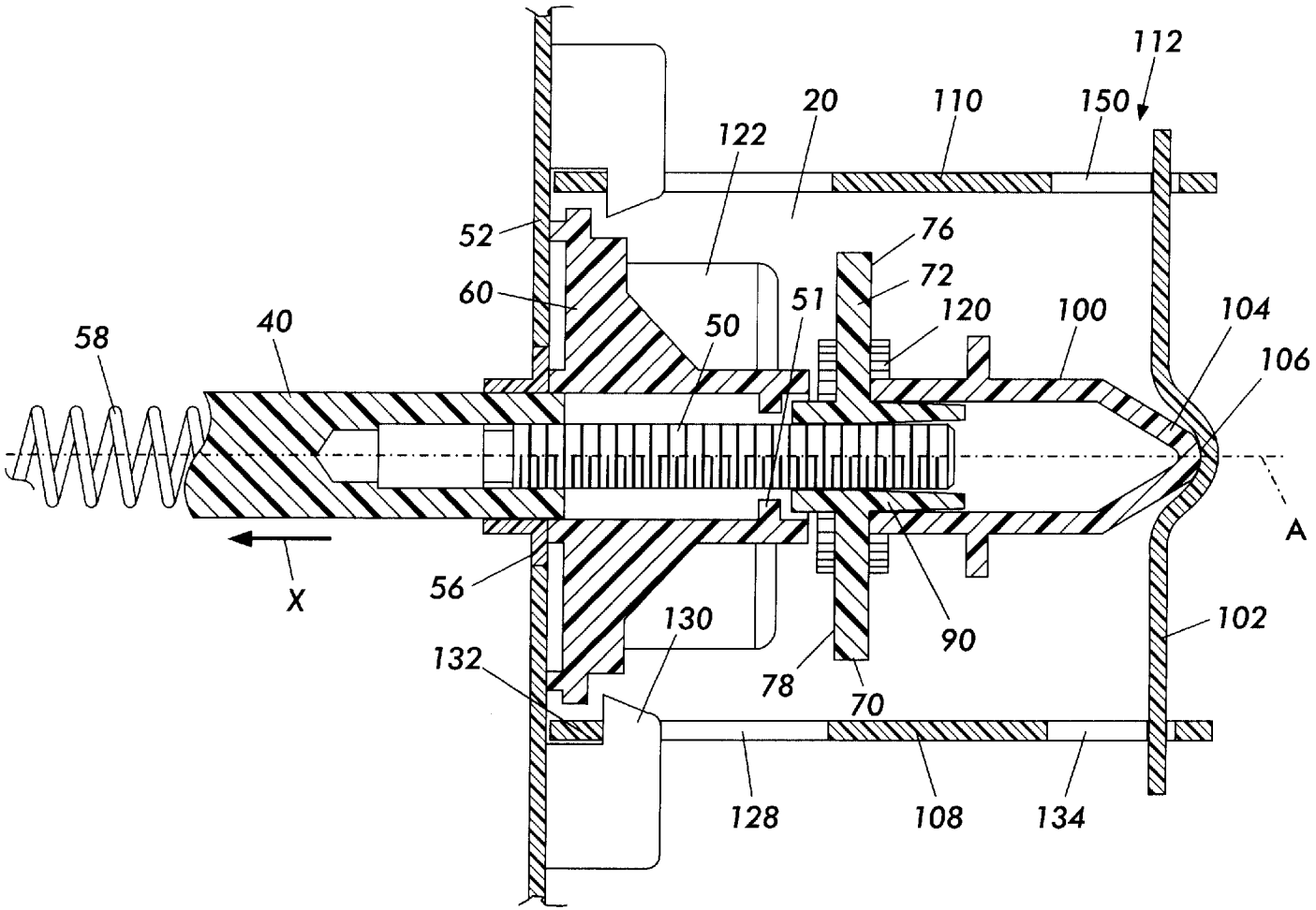
FIG. 6 is a cross sectional view of the print head drive mechanism taken along lines 3—3 of FIG. 5.

With reference now to FIGS. 5 and 6, one embodiment of the print head drive mechanism 20 of the present invention will now be described. As shown in FIG. 5, in this embodiment the print head 18 is mounted to a shaft 40 by mounting towers 42, 44 at each end of the print head. As explained in more detail below, the print head drive mechanism 20 translates the shaft 40 and coupled print head 18 in a direction parallel to the X-axis.

With reference to FIG. 6, a lead screw 50 is rigidly coupled to one end of the shaft 40. The shaft 40 is supported by two bushings in the printer chassis side panels 52, 54, with the bushing 56 in side panel 52 being visible in FIG. 6. A biaser, such as an extension spring 58, is connected to the shaft 40 and the side panel 52 to provide a preload force that biases the shaft and print head 18 toward the side panel 52.

With continued reference to FIG. 6, a collar 60 extends from the side panel 52 and is coaxial with an axis of rotation A of the lead screw 50 and an internally threaded element through which the lead screw extends. In a preferred embodiment, the internally threaded element comprises a gear 70 rotatable about the axis of rotation A. The gear 70 includes a disc portion 72 and teeth 74 around the periphery of the disc portion. The disc portion 72 includes an outer face 76 and an inner face 78. At the center of the gear 70 is a threaded hub 90. The threads of the hub 90 mesh with the threads on the lead screw 50. In this manner, as the gear 70 is rotated the lead screw 50 and attached print head 18 are translated along the X-axis. The collar 60 includes a shoulder 51 that limits travel of the gear hub 90 along the X-axis.

Figure 7:
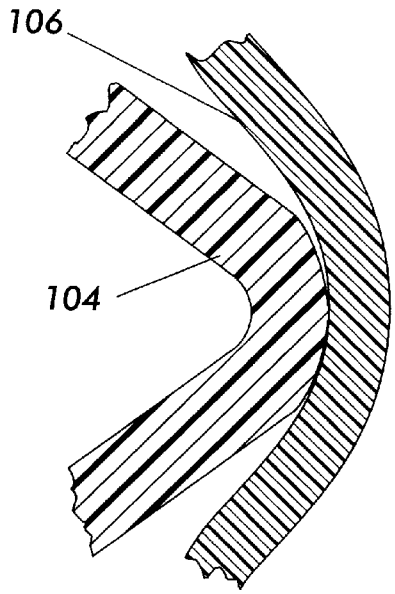
FIG. 7 is an enlarged cross-sectional illustration of the contact point between the tapered nose of the support cylinder and the recess in the brace.

A support cylinder 100 extends from the outer face 76 of the gear 70 to a brace 102. In the preferred embodiment, the support cylinder 100 includes a tapered nose 104 that seats within a recess 106 in the brace 102. The cylinder 100 and tapered nose 104 are preferably formed from a substantially non-compressible and wear-resistant material, such as Nylon 6/10. As best seen in FIG. 7, the radius of curvature of the tapered nose 104 is preferably smaller than the radius of curvature of the recess 106. In this manner, the tapered nose 104 engages the recess 106 with approximately point contact to minimize lateral movement of the tapered nose and cylinder 100 as the cylinder rotates.

The brace 102 cooperates with two spaced-apart legs 108, 110 to form a positioning assembly, generally designated by the reference numeral 112, that constrains transitional motion of the shaft 40 and print head 18 in the direction of the preload force. In this manner, the thrust load of the lead screw 50, transferred through the internal threads of the gear 70 and into the tapered nose 104 of the cylinder 100, is directed into the positioning assembly 112.

Figure 8:
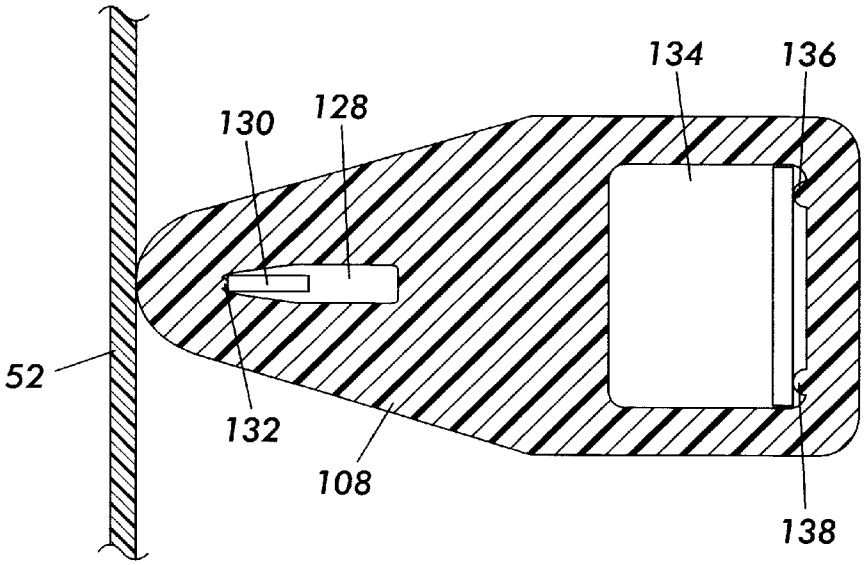
FIG. 8 is a top plan view of a leg from the positioning assembly that maintains the print head drive mechanism in an operating position.

Advantageously, the positioning assembly 112 is essentially non extensible in the X-axis direction, but freely pivotable in a direction perpendicular to the X-axis. FIG. 8 illustrates one leg 108 of the positioning assembly 112. The following description of leg 108 applies equally to the other leg 110. The leg 108 includes a slot 128 that receives a first tab 130 extending from the panel 52. Advantageously, the slot includes a beveled contact point 132 that engages the first tab 130 to provide essentially point contact with the first tab 130 (see also FIG. 6). At an opposite end of the first leg 108 is an opening 134. The opening 134 includes two spaced apart beveled contact points 136, 138 that engage a first end of the brace 102 to provide two spaced apart point contacts with the brace. These two contact points 136, 138 combined with the similar two contact points in the opening 150 in the second leg 110 create a four point engagement between the brace 102 and the first and second legs 108, 110. Advantageously, this configuration allows the positioning assembly 112 to be essentially non-extensible in the direction of the thrust load, while also allowing the assembly to pivot perpendicularly to the X-axis. In this manner, the positioning assembly can accommodate runout in the gear 70 and the tapered nose 104, offsets in the lead screw 50 and other component and system variations without generating significant X-axis movement.

The gear 70 is driven by a pinion 120 that is coupled by a shaft (not shown) to a stepper motor 122. In an important aspect of the present invention, the thread pitch of the lead screw 50 is selected to match the jet column spacing in the print head 18 to eliminate progressive positional errors. The thread pitch is defined as the axial distance traveled for each revolution of the internally threaded element or gear 70. More specifically, where adjacent jets 32 in the print head 18 are spaced apart by a distance X in a direction parallel to the axis of travel, the threads on the lead screw 50 are given a pitch of approximately X/N, where N is an integer. The lead screw thread pitch X/N may utilize any integer value N that yields a manufacturable thread. In the embodiment where N=1, the jet spacing and the pitch of the lead screw threads are approximately equal. For example, where the jets 32 in adjacent columns are spaced apart by a distance of X=0.073 inches, the lead screw 50 is given a 13.636 lead thread, which corresponds to 13.636 revolutions per inch of axial travel. In this embodiment, the lead screw 50 does not rotate but is moved axially by the rotation of the gear 70. Thus, for each rotation of the gear 70, the lead screw 50 is advanced axially by a distance of 1/13.636=0.073 inches.

Advantageously, matching the print head jet spacing with the lead screw pitch minimizes print head positional errors due to runout in the gear 70 and support cylinder 100, thread pitch imperfections and the like. The advantages of this lead screw drive mechanism are particularly apparent for adjacent pixel columns in an image. As explained above, with line interlacing adjacent pixel columns are typically printed by different jet columns. By matching the lead screw pitch with the jet spacing, the angular position of the stepper motor 122 and the gear 70 will be approximately equal for any pair of adjacent pixel columns. Advantageously, this prevents progressive positional errors from introducing white space between adjacent pixel columns.

In one embodiment of the present lead screw drive mechanism, the gear 70 is driven by a stepper motor 122 through a pinion 120 that is one-half the diameter of the gear, yielding a 2:1 gear ratio. Advantageously, this 2:1 ratio is complementary to maintaining cyclical repetition of any progressive positional errors. In this embodiment, the pinion 120 rotates two full turns for each gear rotation, such that any gear eccentricities and/or tooth irregularities contribute only subtle errors which are cyclically non-additive.

In an alternative embodiment, the print head 18 may be coupled to a threaded portion of the shaft 40 through one or more nuts. The threads on the shaft 40 have a pitch of approximately X/N, where N is an integer. A driver such as a motor rotates the shaft 40 to translate the nut and the print head. In this embodiment, the thread pitch is defined as the axial distance traveled for each revolution of the shaft 40. As with the first embodiment, N revolutions of the shaft cause translation of the nut and print head by a distance X that is substantially equal to the distance X between adjacent jets in the print head.

Both embodiments of the above-described drive mechanism of the present invention may utilize fairly inexpensive off the shelf components. Advantageously, the present drive mechanism provides accurate positional control without the expense and complexity of high precision parts.

The foregoing description of preferred embodiments of the invention has been presented for purposes of illustration and description. It is not intended to be exhaustive or to limit the invention to the precise form disclosed. The terms and expressions which have been employed in the foregoing specification are used therein as terms of description and not of limitation. The use of such terms and expressions is not intended to exclude equivalents of the features shown and described or portions thereof. Many changes, modifications, and variations in the materials and arrangement of parts can be made, and the invention may be utilized with various different imaging apparatus, all without departing from the inventive concepts disclosed herein.

The above embodiments were chosen and described to provide the best illustration of the principles of the invention and its practical application to thereby enable one of ordinary skill in the art to utilize the invention in various embodiments and with various modifications as is suited to the particular use contemplated. All such modifications and variations are within the scope of the invention as determined by the appended claims when the claims are interpreted in accordance with breadth to which they are fairly, legally, and equitably entitled.

What is claimed is:

1. A print head drive mechanism for positioning a print head along an axis of travel, the print head including a plurality of jets in which adjacent jets are spaced apart by a distance X in a direction parallel to the axis of travel, the print head drive mechanism comprising:

a lead screw coupled to the print head for translating the print head in a direction parallel to the axis of travel;

threads on the lead screw having a pitch of approximately X/N, where N is an integer;

an internally threaded element engaging the lead screw threads; and a driver that causes rotation of the internally threaded element, whereby N revolutions of the internally threaded element cause translation of the lead screw and the print head by a distance that is substantially equal to the distance X between adjacent jets, whereby positional variances of the print head are strategically located along the axis of travel.

2. The print head drive mechanism of claim 1, wherein the internally threaded element is a gear that is rotatable about an axis of rotation, the gear comprising:

a disc portion and teeth around a periphery of the disc portion, the disc portion including an outer face and an inner face; and a hub having threads.

3. The print head drive mechanism of claim 2, further including:

a brace spaced from the outer face of the gear; and a support cylinder extending from the outer face of the disc portion of the gear to the brace.

4. The print head drive mechanism of claim 3, wherein the brace includes a recess and the support cylinder includes a tapered nose that seats within the recess.

5. The print head drive mechanism of claim 4, wherein the gear hub extends beyond the outer face and into the support cylinder.

6. The print head drive mechanism of claim 2, wherein the gear hub extends beyond the inner face of the disc portion, and further including:

a panel spaced from the inner face of the gear; and a collar extending from the panel and coaxial with the axis of rotation of the gear, the inner diameter of the collar being greater than the outer diameter of the gear hub.

7. The print head drive mechanism of claim 6, wherein the collar includes a shoulder encircling an internal periphery of the collar, the shoulder limiting travel of the gear hub along the axis of travel.

8. The print head drive mechanism of claim 1, wherein the lead screw includes a first portion extending through the internally threaded element and a second portion that is fastened to a shaft, and the print head is mounted to the shaft.

9. The print head drive mechanism of claim 8, further including a biaser connected to the shaft that biases the shaft toward the internally threaded element.

10. The print head drive mechanism of claim 1, wherein the distance X is approximately 1.78 mm.

11. A print head drive mechanism for positioning a print head along an axis of travel, the print head drive mechanism comprising:

a gear rotatable about an axis of rotation, the gear having a disc portion and teeth around a periphery of the disc portion, the disc portion including an outer face and an inner face, the gear including a hub having threads;

a lead screw including a first portion extending through the hub and a second portion coupled to the print head for translating the print head in a direction parallel to the axis of travel;

a brace spaced from the outer face of the gear;

a support cylinder extending from the outer face of the disc portion of the gear to the brace; and a pinion engaging the teeth of the gear, whereby rotation of the pinion causes rotation of the gear, which in turn causes translation of the lead screw and the print head.

12. The print head drive mechanism of claim 11, wherein the brace includes a recess and the support cylinder includes a tapered nose that engages the recess.

13. The print head drive mechanism of claim 11, wherein the gear hub extends beyond the outer face and into the support cylinder.

14. The print head drive mechanism of claim 11, further including:

a panel spaced from the inner face of the gear; and a collar extending from the panel and coaxial with the axis of rotation of the gear, the inner diameter of the collar being greater than the outer diameter of the gear hub.

15. The print head drive mechanism of claim 14, wherein the gear hub extends beyond the inner face of the disc portion, and the collar includes a shoulder encircling an internal periphery of the collar, the shoulder limiting travel of the gear hub along the axis of travel.

16. The print head drive mechanism of claim 11, wherein the second portion of the lead screw is affixed to a shaft and the print head is mounted to the shaft.

17. The print head drive mechanism of claim 16, further including a biaser connected to the shaft that biases the shaft toward the gear.

18. The print head drive mechanism of claim 11, wherein a gear ratio of the pinion to the gear is 2:1.

19. A print head drive mechanism for positioning a print head along an axis of travel, the print head including a plurality of jets in which adjacent jets are spaced apart by a distance X in a direction parallel to the axis of travel, the print head drive mechanism comprising:

a nut coupled to the print head;

a lead screw extending through the nut;

threads on the lead screw having a pitch of approximately X/N, where N is an integer; and a driver that causes rotation of the lead screw, whereby N revolutions of the lead screw cause translation of the nut and the print head by a distance that is substantially equal to the distance X between adjacent jets, whereby positional variances of the print head are strategically located along the axis of travel.

* * * * *